United States Patent [19]

Goulette

[11] Patent Number: 4,880,178

[45] Date of Patent: Nov. 14, 1989

[54] ROLL UNWIND BUTT SPLICER

[75] Inventor: Stephen L. Goulette, Newark, N.Y.

[73] Assignee: Mobil Oil Corporation, New York, N.Y.

[21] Appl. No.: 228,146

[22] Filed: Aug. 4, 1988

[51] Int. Cl.[4] ..... B65H 19/14; B65H 19/18; B31F 05/00

[52] U.S. Cl. ..... 242/58.1; 242/58.4; 242/58.5; 156/506

[58] Field of Search ..... 242/58.1–58.6; 156/502, 504, 505–508

[56] References Cited

U.S. PATENT DOCUMENTS 3,995,791 12/1976 Schoppee .
4,161,364 7/1979 Hanai et al. .
4,234,365 11/1980 Shimizu et al. ..... 156/505 X
4,262,855 4/1981 Haag .
4,315,794 2/1982 Palmieri .
4,386,988 6/1983 Kontz .
4,481,053 11/1984 Tokuno et al. .
4,506,842 3/1985 Beck .
4,543,152 9/1985 Nozaka ..... 242/58.4 X
4,555,070 11/1985 Pali .
4,564,149 1/1986 Barzano .
4,599,130 7/1986 Woodley .
4,769,098 9/1988 Lederholm et al. ..... 242/58.4 X

*Primary Examiner*—Stuart S. Levy
*Assistant Examiner*—Steven M. duBois
*Attorney, Agent, or Firm*—Alexander J. McKillop; Charles J. Speciale

[57] ABSTRACT

An apparatus for splicing the trailing end of an unwind depleted web of material to the lead end of a new web of material in a registered and/or abutting mode without the need for any appreciable overlap between the ends of the ceasing or slow-down of the continual forward advance of the web towards a work station, for instance, such as a thermoformer.

7 Claims, 5 Drawing Sheets

ROLL UNWIND BUTT SPLICER

BACKGROUND OF THE INVENTION

1. Field of the Invention

The present invention relates to an apparatus for splicing the trailing end of an unwinding depleted web of material to the lead end of a new web of material in a registered and/or abutting mode without the need for any appreciable overlap between the ends of the two webs being joined together or which would necessitate the ceasing or slow-down of the continual forward advance of the web towards a work station, for instance, such as a thermoformer.

In essence, during the operation of various types of installations such as thermoformers or the like which are employed for the molding of plastic articles, as is generally well-known in the plastics technology, a continuous web of a sheet material; for instance, constituted from a polystyrene foam, is unwound from a suitable supply roll and continually advanced to the thermoformer. As the trailing or terminal end portion of the depleted and expiring web is unwound from the supply roll, in order to afford for the continuity in the feed of web material to the thermoformer and thereby avoid the necessity of having to temporarily suspend the operation of the thermoformer, a new supply roll of a web of polystyrene foam material has the lead end thereof spliced to the trailing end of the expiring or depleted web. This procedure is generally implemented by the interconnection of the contiguous or mating ends of the webs through the interposition of a tape for splicing the two webs together in a substantially registered alignment and/or abutting contact and thereafter, with the utilization of a suitable cutting tool or like severing implement, separating the remaining selvage or trailing end segment of the depleted web of polystyrene foam material from the now spliced together webs. It is highly desirable that this type of butt joint in the attachment or splicing of a new web of the material to an expiring web is able to be effected with a relatively high degree of precision in operation so as to thereby preclude any overlapping of the material of the joined webs which would tend to adversely affect the quality of the webs passing through the thermoformer, particularly, at the locations in which the expiring web is spliced to a new web of polystyrene foam material.

2. Discussion of the Prior Art

Although numerous kinds of apparatus are currently in existence and in commercial use, and which provide for the splicing of webs of various types of material, such as paperboard, thermoplastic films, and foamed polystyrene employed for the molding of plastic articles; generally these apparatus are of substantially complex construction and frequently necessitate additional work steps in providing the alignment and registration between webs which are to be spliced, including requiring the severing of the remaining trailing end portion of the depleted web of material be carried out in a further operation.

Barzano U.S. Pat. No. 4,564,149 discloses a device for the joining together in a registered and/or abutting mode, the ends of two paper or cardboard webs which are unwound and supplied from different reels and which are joined or bonded together at a suitable splicing location through the intermediary of an adhesive tape or bonding material applied at the web juncture. Although this prior art device provides for a generally accurate method in the joining together of the webs in an abutting manner, the device necessitates the subsequent separate step of severing the trailing end of the expiring web after the application of the adhesive tape. Consequently, the operation and structure of this device is relatively complex and cumbersome in size and functioning.

Haag U.S. Pat. No. 4,262,855 provides for a web splicing apparatus in which a system incorporating complex electrical eye and control devices is employed in order to register and align the leading end of a new web of a material with the trailing end of an expiring web, in which the webs are dispensed from separate supply rolls. This particular apparatus requires the stoppage of the web feed so as to allow for the operation of the web splicing mechanism. In contrast with the present invention, which allows for the practically continuous advance of the web being fed to a thermoformer, the utilization of this prior art apparatus during splicing operations would necessitate the frequent stoppage of the supply of the polystyrene foam web to the thermoformer, thereby adversely affecting the efficiency of thermoformer operation.

Beck U.S. Pat. No. 4,506,842 discloses a device for splicing a moving expiring web of material to a new roll of web material whereby, subsequent to the web splicing operation, the trailing end of the depleted web is severed in response to a control signal received from a sensing arrangement. This fails device, however, does not incorporate features for the generally concurrent severing of the trailing end portion or selvage of the expiring polystyrene foam web with the abutting splicing to the lead end of a new web, such as is contemplated by the present invention.

Other apparatuses which are directed to the splicing of continuous webs of material are disclosed in various U.S. patents; however, none of which provide for the type of concurrent web splicing operation and structure analogous to that of the present roll unwind butt splicer. These patents include U.S. Pat. Nos. 4,161,364 to Hanai et al.; 4,481,053 to Tokuno, et al.; 4,555,070 to Pali; 4,386,988 to Kontz; 4,599,130 to Woodley; 4,315,794 to Palmieri; and 3,995,791 to Schoppee.

SUMMARY OF THE INVENTION

In order to eliminate or alleviate the limitations and shortcomings which are generally encountered in currently known and commercially employed web splicing apparatus of the type under consideration, the present invention contemplates the provision of butt splicing apparatus for joining together, in a substantially abutting and registered aligned relationship the tail end portion of a first expiring web which is being dispensed by being unwound from a first supply reel with the lead end of a new web of material being held in a state of readiness, such as a polystyrene foam, wherein the web are adapted to be advanced to a thermoformer or the like for producing molded plastic articles, through the interposition at the web splicing location of a preferably polystyrene-backed tape which is adhered to the leading end of the new web and maintained in a position of readiness against a splice bar through the application of a vacuum while the first web is being depleted as it is fed to the thermoformer. In response to a signal from a suitable detecting device sensing the impending expiration of the first web, the prepared lead end of the new web, with the splicing tape attached thereto, is brought into position so as to cause the tape to contact the trailing end portion of the expiring web, with the tape adhesively engaging the surface of the expiring web. Substantially concurrently with the foregoing the remaining tail end or selvage part of the expiring web extending beyond the web splicing location severed through the application of a cutting blade or knife or any other suitable severing implement, and the new web in its spliced relationship with the tail end of the old web is now advanced towards the thermoformer. This particular sequence of operation does not necessitate any appreciable slow-down or stoppage of the web being conducted to the thermoformer, and provides for the abutting splicing of the contiguous ends of the expiring and new webs. Thereafter, the reel with the remaining portion of the depleted web wound thereon may be replaced by a new reel having a full roll of web material wound thereon, and the lead end of the latter may be conducted to a preparation station so as to be supplied with tape and maintained in a position of readiness for attachment to the prior web when the latter is about to expire, as described hereinabove.

The inventive apparatus, in a relatively simple and expedient manner, allows for the rapid and accurate splicing in an abutting manner of webs of material of the type under consideration herein without, to any significant degree, necessitating the slow-down or stoppage of the web which is being conducted towards a thermoformer installation.

Accordingly, it is an object of the present invention to provide a novel roll unwind butt splicing apparatus for attaching the trailing end portion of an expiring web to the lead end of a new web of a material of the material.

It is a more specific object of the present invention to provide an apparatus of the type described, for the butt splicing of thermoplastic film webs or the like, in which the leading end of a new web of material is maintained in readiness through the application of an adhesive tape adapted to be attached to the tail end of an expiring web with a precisely registered abutting relationship of the webs.

Yet another object of the present invention is to provide a roll unwind butt splicing apparatus of the type described herein, in which the trailing end portion of the expiring or depleted web material downstream of the web joint is severed concurrently with the splicing of the trailing end portion thereof with the lead end of a new web of material.

BRIEF DESCRIPTION OF THE DRAWINGS

Reference may now be had to the following detailed description of a preferred embodiment of a roll unwind butt splicing apparatus pursuant to the present invention, taken in conjunction with the accompanying drawings; in which.

DETAILED DESCRIPTION

Figure 1:
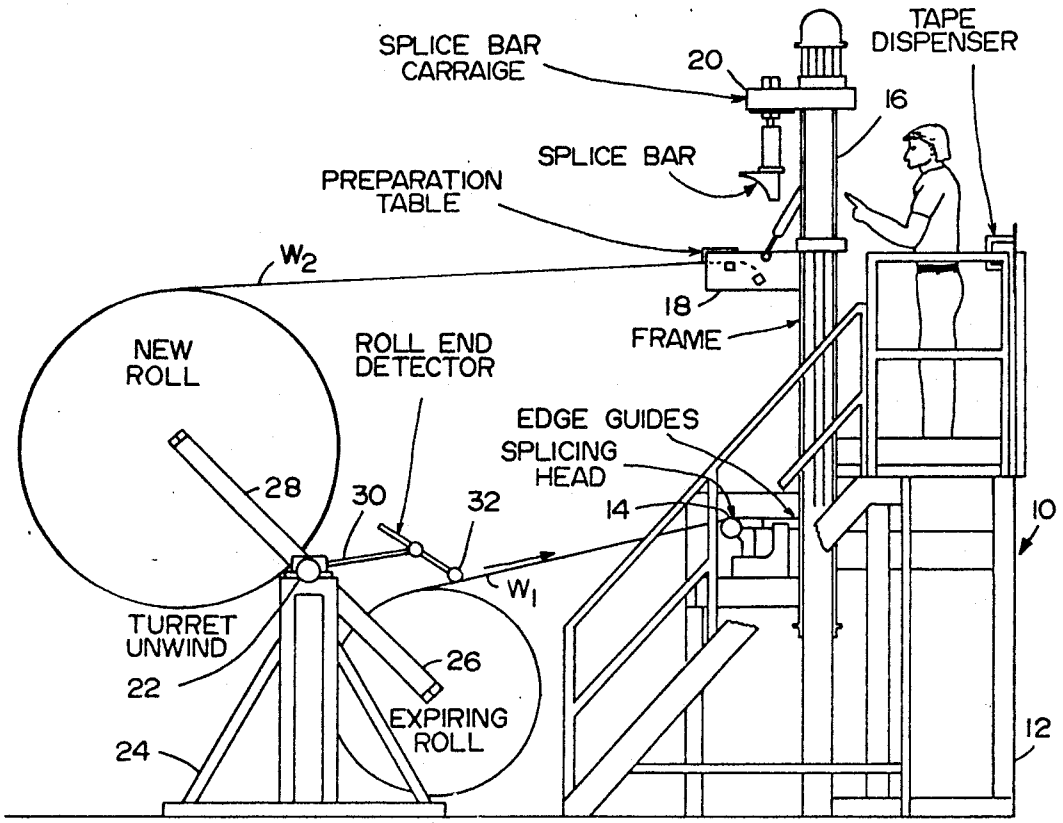
FIG. 1 illustrates a generally schematic side elevational view of the inventive butt splicing apparatus for joining the contiguous ends of continuously advanced webs.
Figure 2:
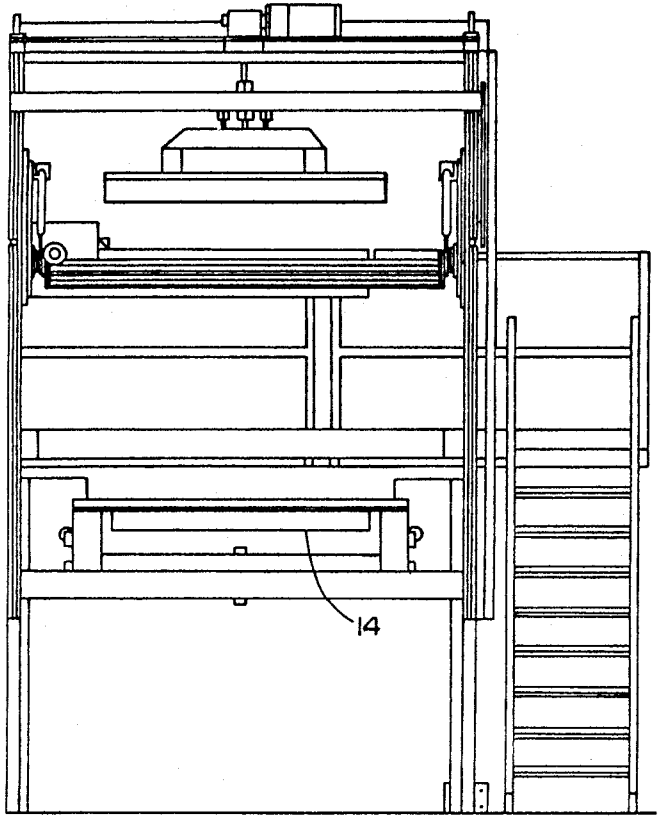
FIG. 2 is a front elevational view of the inventive apparatus.

Referring now in specific detail to the drawings, and particularly FIGS. 1 and 2, there is illustrated the roll unwind butt splicing apparatus 10 pursuant to the invention, which includes a framework 12 for supporting a splicing unit 14 which is adapted to join, in a registered and abutting relationship, the tail end of an expiring web of a thermoplastic material which being advanced through the splicing apparatus, to the leading end of a new web being supplied from a suitable source, such as a wound roll, as described more extensively hereinbelow.

Moreover, the splicing apparatus 10 incorporates a vertical support column 16 having a suitable preparation table 18 arranged thereon adapted to vertically displaced, for preparing the leading end of the new web; and a vertically displaceable splice bar carriage 20 designed to operatively cooperate with the splicing unit 14 in order to be able to join the tail end of an expiring web to the leading end of a new web, while concurrently severing the selvage or trailing remainder of the expiring web at the web splicing location.

A star wheel 22, which is positioned in proximity to the splicing apparatus 10, and which is supported on a framework 24, includes a first arm system 26 supporting in this instance as illustrated, an expiring web $W_1$ of a thermoplastic film material which is being unwound from the roll supported at the end of arms 26, and with the $W_1$ being conveyed past the splicing unit 14, while the latter is in an inoperative or "standing" position, towards a suitable thermoforming installation (not shown) for the molding of plastic articles as is well known in the art.

Supported at the end of an arm system 28 opposite arms 26 on the star wheel 22 is a new roll of a web $W_2$ of thermoplastic film material which is being prepared or staged so as to be in readiness for splicing in an abutting and registered relationship with the tail end of the expiring web $W_1$, in response to the sensing of the depletion of the web $W_1$ through the intermediary of a suitable roll end detector 30.

The roll end detector 30 incorporates a sensor or feeler 32 which, supported under its own weight, rides on the surface of the web $W_1$, and in response to the reduction in the diameter of the wound roll of the web $W_1$ in response to the latter is being drawn off from the star wheel 22, causes the feeler 32 to move downwardly and at a predetermined displacement thereof, produce the generation of a signal indicative of the imminent expiration or depletion of the web $W_1$, so as to resultingly activate the splicing apparatus 10 to initiate a web splicing operation.

While the web $W_1$ is being advanced from the star wheel 22, passing through the essentially dormant or temporarily inactive splicing apparatus 10 towards a suitable thermoforming installation (not shown) the new web $W_2$ is being placed or staged into a condition of readiness for the butt splicing operation to the expiring web $W_1$ as the latter is being depleted from the unwinding roll thereof.

Figure 4:
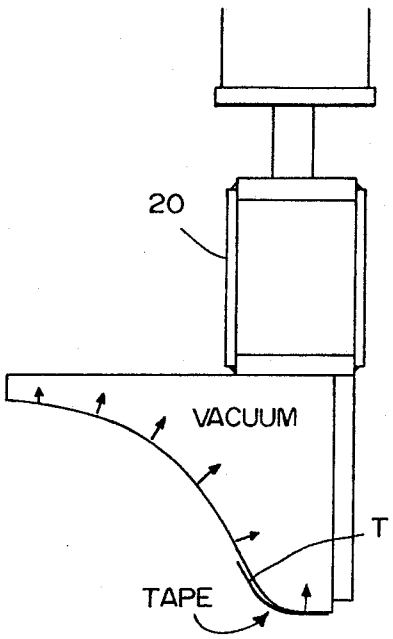
FIG. 4 illustrates, on an enlarged scale, the encircled portion A in FIG. 3.
Figure 5:
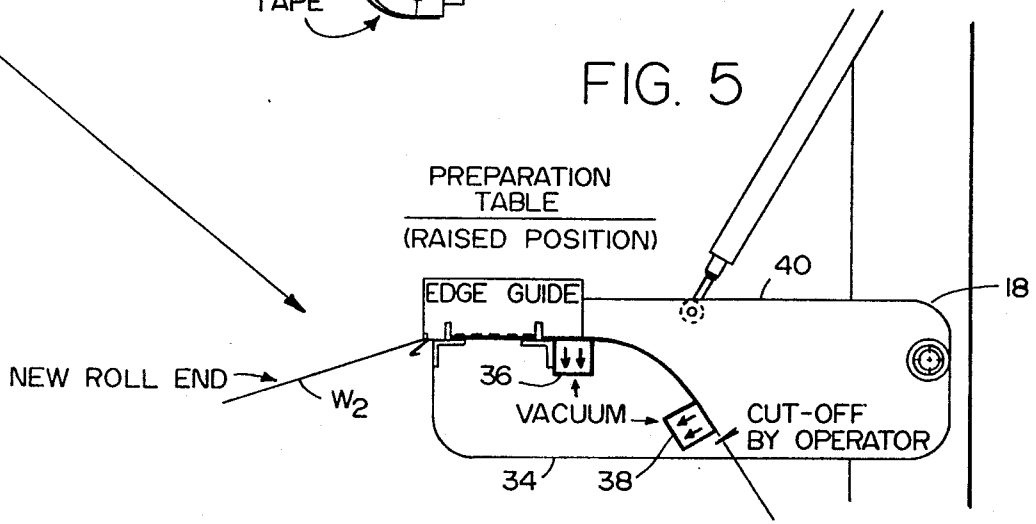
FIG. 5 illustrates, on an enlarged scale, the encircled portion B in FIG. 3.
Figure 3:
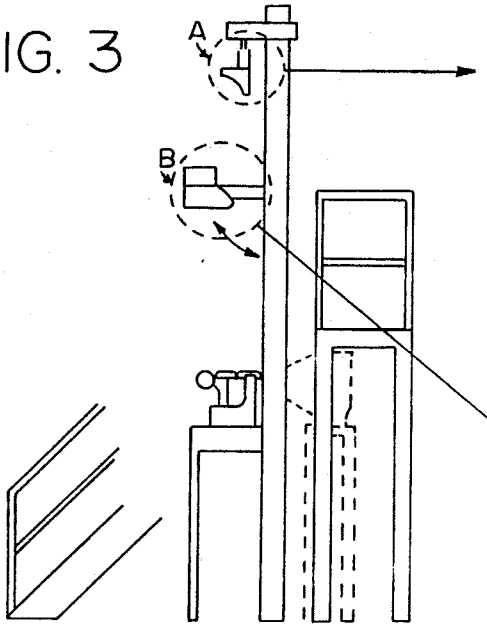
FIG. 3 schematically illustrates the portion of the apparatus for preparation of a new web end.

As illustrated in FIGS. 3 through 5 of the drawings, with the splice bar 20 being maintained in a raised position on the vertical column 16 of the apparatus, a strip of tape T, preferably constituted from a polystyrene-backed tape, is adhered to the surface of the splice bar 20 and maintained thereagainst through the imposition of a vacuum therein so as to maintain the tape T in a fixed position.

The leading end of the new web $W_2$, as more clearly shown in the enlarged detail of FIG. 5, is introduced in the preparation table 18, and initially adhered to a lower vacuum chamber portion 34 thereof through the interposition of a vacuum at surface locations 36 and 38, with an excess leading end segment of the new web $W_2$ being severed through a cutter in upper table unit 40 by an operator.

Figure 7:
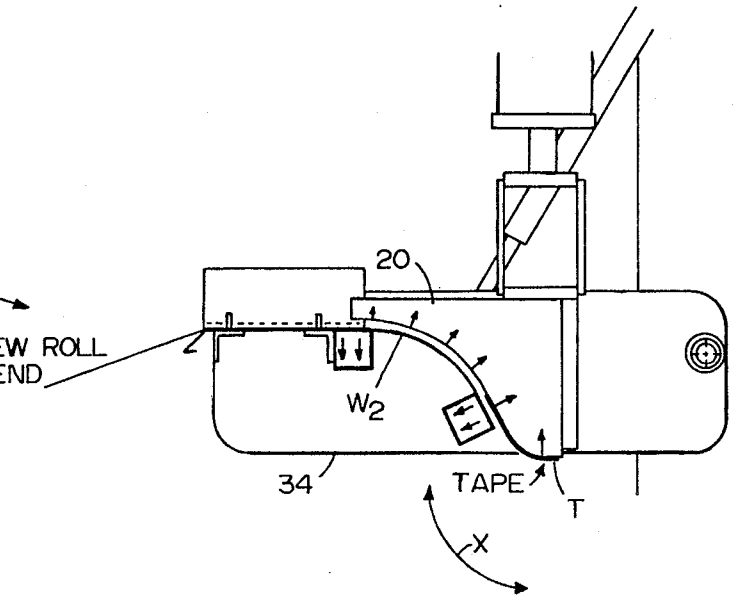
FIG. 7 illustrates, on an enlarged scale, the transfer of the lead end of the new roll.
Figure 6:
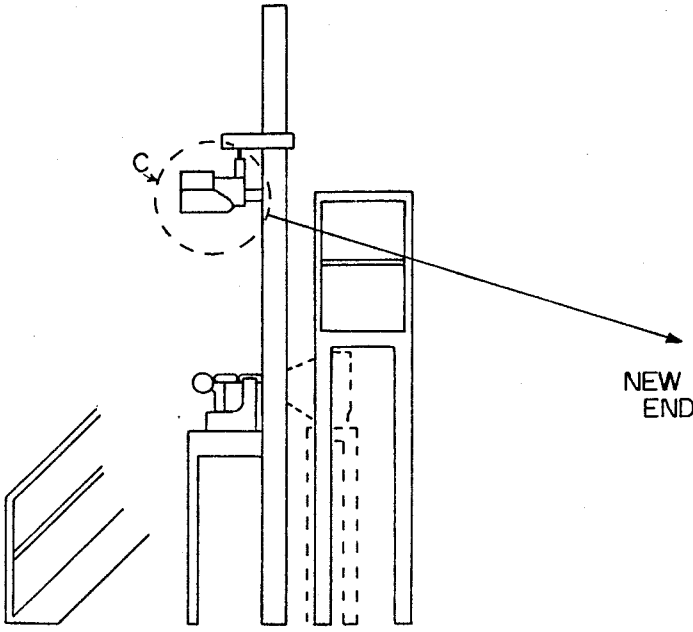
FIG. 6 illustrates the apparatus in preparation for the transfer of the lead end of a new roll of web material.

Thereafter, as illustrated in FIGS. 6 and 7 of the drawings, the splice bar 20 with the tape T in position thereon is brought into adhesive contact with the trimmed leading end of the new web $W_2$ as the latter is retained in contact with the vacuum chamber portion 34 of preparation table 18 under the action of a vacuum.

Thereafter, the vacuum is released at vacuum locations 36 and 38, and the component 34 displaced into an inoperative position in the downward direction of the arrow X, while a vacuum is maintained in the splice bar 20.

Figure 9:
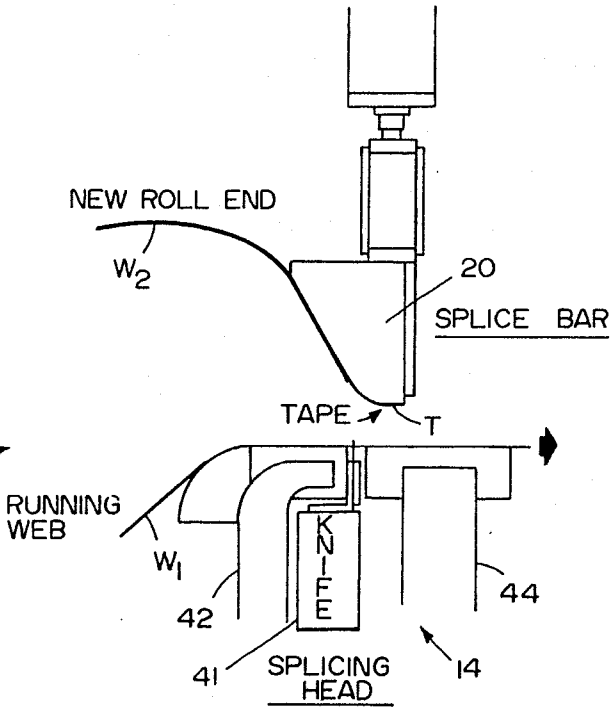
FIG. 9 illustrates on an enlarged scale the encircled detail D in FIG. 8.
Figure 8:
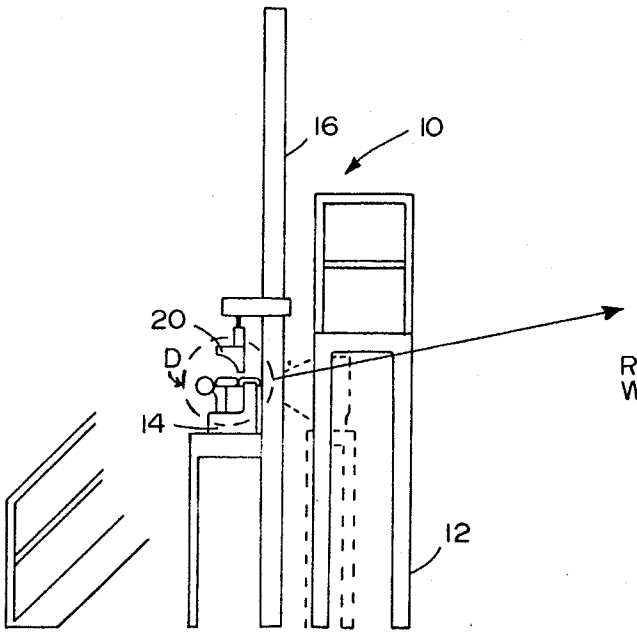
FIG. 8 illustrates the staging end of the new roll prior to attachment thereof to the trailing end portion of an expiring web.

This causes the leading end of a new web $W_2$, together with the tape T adhesively applied to and predeterminately projecting from the leading end thereof as shown in FIG. 7, to be staged into a condition of readiness for a splicing operation with trailing end of the expiring web $W_1$, as is more clearly illustrated in and explained in connection with FIGS. 8 and 9 of the drawings. In this instance, the prepared leading end of the new web $W_2$ with the tape T attached thereto, and held against the surface of the splice bar 20 through the presence of a vacuum in the latter, is positioned directly above and in proximity with the splicing unit 14, which incorporates the structure of a severing element 41, such as a cutting knife, a front vacuum table 42 and a rear vacuum table 44, with the severing element 41 being retracted therebetween and able to be raised through a gap between the table portions 42, 44 during its operation.

Figure 11:
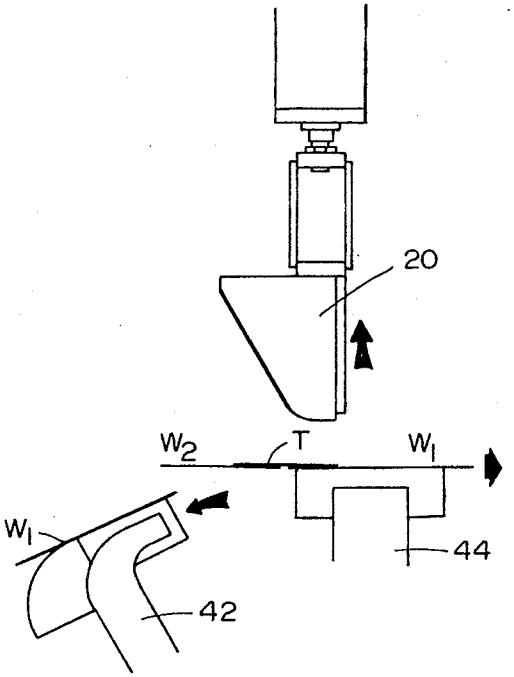
FIG. 11 illustrates the completion of the web splicing and selvage severing sequence.
Figure 10:
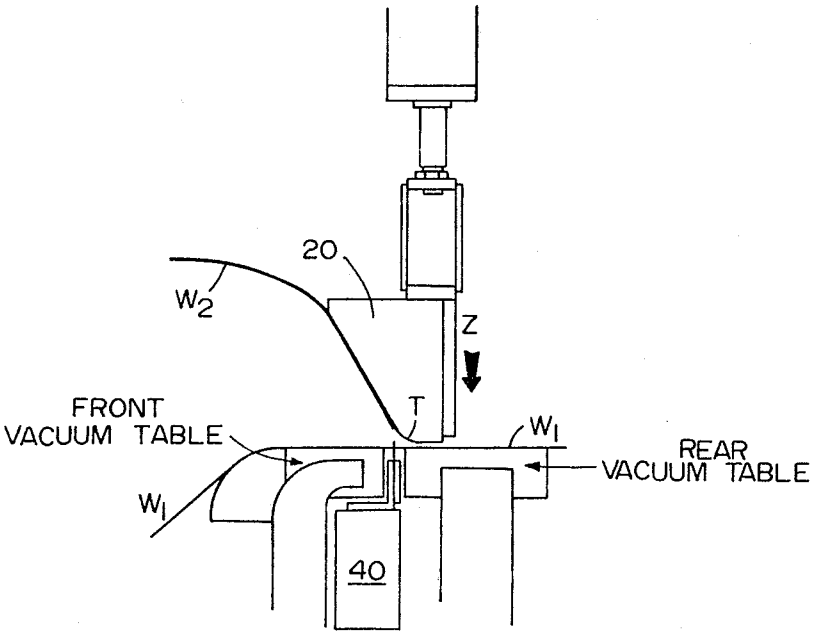
FIG. 10 illustrates the splicing operation of the inventive apparatus.

More particularly, as shown in FIGS. 10 and 11 of the drawings, as the roll end detector 32 causes a signal to be emitted, indicative that the web $W_1$ is about to expire, the splice bar 20 with the lead end of new web $W_2$ and tape T held thereagainst through the interposition of a vacuum in the splice bar, is moved into surface-contacting engagement with the web $W_1$, the advance of which has been temporarily restricted, and is maintained in an aligned or registered abutting webs position by the application of vacuums in both the front vacuum table 42 and the rear vacuum table 44 of the splicing unit. The downward movement of the splice bar 20 in the direction of arrow Z in FIG. 10 causes the tape T to contact with and adhere to the surface of the trailing end portion of expiring web $W_1$. Concurrently with this splicing procedure, the knife 41 is raised through the gap between tables 42, 44 so as to sever the remaining end portion or selvage of the web $W_1$ immediately rearwardly of the tape T so as to avoid the formation of any overlap of material between the expiring web $W_1$ and the lead end of the new web $W_2$. At this point in time, the vacuum in the splice bar 20 is released, and the latter again displaced upwardly into its initial position along the vertical support column 16. While the front vacuum table 42 has the vacuum therein released after being pivoted in the direction of arrow L towards the left, so as to take along the cut-off end or selvage of the expired web $W_1$ for disposed thereof, the vacuum is almost simultaneously released in table 44, and advance of the now spliced webs $W_1$ and $W_2$, joined together abuttingly by the tape T, is again commenced in the direction towards the thermoforming installation.

At this time, a new roll is mounted onto the arms 26 of the star wheel 22 in lieu of the remainder of the roll of the expired web $W_1$, with the web $W_2$ being rotated to place the sensor 32 into position thereon, and also to enable an operator to repeat the procedure in staging the lead end of such a new roll and attaching tap thereto by allocation of a new strip of tape from a suitable tape dispenser, in a manner as described hereinbefore. This will then enable the subsequent splicing in an abutting relationship of the new web to the tail end portion of the web $W_2$ as the latter is depleted, thereby allowing for substantially continuous operation of any thermoformer installation without any lengthy stoppage of the web advance.

A particular aspect of the invention resides in that the entire butt splicing apparatus may be retrofitted on existing splicing equipment without the necessity of having to provide additional floor space or having to modify the normal operation of all currently employed thermoforming equipment, while providing a continual supply of polystyrene or suitable web roll stock to the installation.

While there has been shown and described what are considered to be preferred embodiments of the invention, it will, of course, be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. An apparatus for the joining together of the tail end of an expiring first web being dispensed from a wound roll which is supported on a first reel with the lead end of a new second web of a wound roll which is supported on a second reel; comprising: means for rotatably supporting said first reel and said second reel; means for attaching an adhesive tape to the lead end of said second web and maintaining said lead end and adherent tape in a standby position; said apparatus including vertical support columns, said means for attaching said adhesive tape to said second tape including a splicing bar having a vacuum selectively applied thereto for retaining said tape in surface contact therewith, said splicing bar being mounted to be vertically displaceable along said columns; a preparation table being pivotably mounted relative to said columns and receiving the lead end of said second web, said splicing bar adhesively contacting said tape with said second web; means for sensing the impending expiration of said first web being unwound from said first reel; means for causing the tape on said second web to adhesively contact said first web proximate the tail end thereof in response to a signal from said means sensing the impending expiration of said first web and to form a connection between said first and second webs; and means for severing the selvage end of said first web immediately upstream of the region of contact of said first web with said adhesive tape so as to produce an abutting joint between said webs; said means for attaching said adhesive tape to the lead end of said second tape preparing the lead end of a further web for subsequent joining to the tail end of said second web upon impending expiration of said second web so as to provide a continual feed of abuttingly joined webs.

2. Apparatus as claimed in claim 1, comprising means for raising said splicing bar away from said preparation table so as to position said tape with the lead end of said second web attached to said tape in a standing condition over a web splicing structure.

3. Apparatus as claimed in claim 2, wherein said web splicing structure includes first and second vacuum tables having web severing means retracted therebetween in a normally inoperative position, said splicing bar being lowered towards said web splicing structure so as to cause said tape to adhesively contact the tail end portion of said expiring first web responsive to said signal from said sensing means, and means for concurrently actuating said severing means for severing the selvage of said first web immediately upstream of the tape splicing said first and second webs to form said abutting relationship between said webs.

4. Apparatus as claimed in claim 3, comprising means for releasing the vacuum in said first and second vacuum tables subsequent to the splicing of said first and second webs and severing the selvage of said first web, and retracting the splicing bar into a position for adhering the lead end of a subsequent web to a tape mounted on said splicing bar.

5. Apparatus as claimed in claim 3, wherein said selvage severing means comprises a cutting blade extendable into the path of travel of the second web intermediate said first and second vacuum tables.

6. Apparatus as claimed in claim 1, wherein said means for rotatably supporting said first and second web reels comprises a starwheel, said sensing means being supported from said starwheel.

7. A method for the joining together of the tail end of an expiring first web being dispensed from a wound roll with the lead end of a new second web of a wound roll; comprising:

continually advancing and dispensing said first web from said wound roll;

attaching an adhesive tape to the lead end of said second web through the application of a vacuum therebetween and maintaining said lead end and adherent tape in a standby position;

sensing the impending expiration of said first web being unwound from said roll;

causing the tape on said second web to be operatively displaced so as to adhesively contact said first web proximate the rail end thereof in response to a signal generated by the sensing of the impending expiration of said first web and forming a connection between said first and second webs;

severing the selvage end of said first web immediately upstream of the region of contact with said adhesive tape so as to form an abutting joint between said first and second webs;

and preparing the lead end of a further web and attaching an adhesive tape thereto for subsequent joining to the tail end of said second web upon impending expiration of said second web so as to provide a continual feed of abuttingly joined webs.

* * * * *